United States Patent [19]

Ciaffone et al.

[11] Patent Number: 4,461,079

[45] Date of Patent: Jul. 24, 1984

[54] METHOD AND APPARATUS FOR CHANGING THE SHAVING ATTITUDE OF A BLADE PACKAGE

[75] Inventors: John T. Ciaffone, Bridgeport; Ernest A. Ortiz, Cheshire, both of Conn.

[73] Assignee: Warner-Lambert Company, Morris Plains, N.J.

[21] Appl. No.: 383,643

[22] Filed: Jun. 1, 1982

[51] Int. Cl.[3] ..... B26B 21/22

[52] U.S. Cl. ..... 30/79; 30/54; 30/57; 30/80

[58] Field of Search ..... 30/54, 47, 57, 79, 80

[56] References Cited

U.S. PATENT DOCUMENTS

| | | | |
|---|---|---|---|
| 3,815,233 | 6/1974 | Carroll | 30/47 |
| 4,335,508 | 6/1982 | Francis et al. | 30/57 X |
| 4,337,575 | 7/1982 | Trotta | 30/57 X |

*Primary Examiner*—E. R. Kazenske
*Assistant Examiner*—Willmon Fridie
*Attorney, Agent, or Firm*—R. S. Strickler

[57] ABSTRACT

A razor cartridge including a body portion, a guard bar fixed to the body portion, a blade seat and one or more blades defining a blade pack carried by the blade seat, where the blade seat is movably mounted or hinged to the body portion so that the blade pack is free to move relative to the guard bar in response to shaving forces.

3 Claims, 10 Drawing Figures

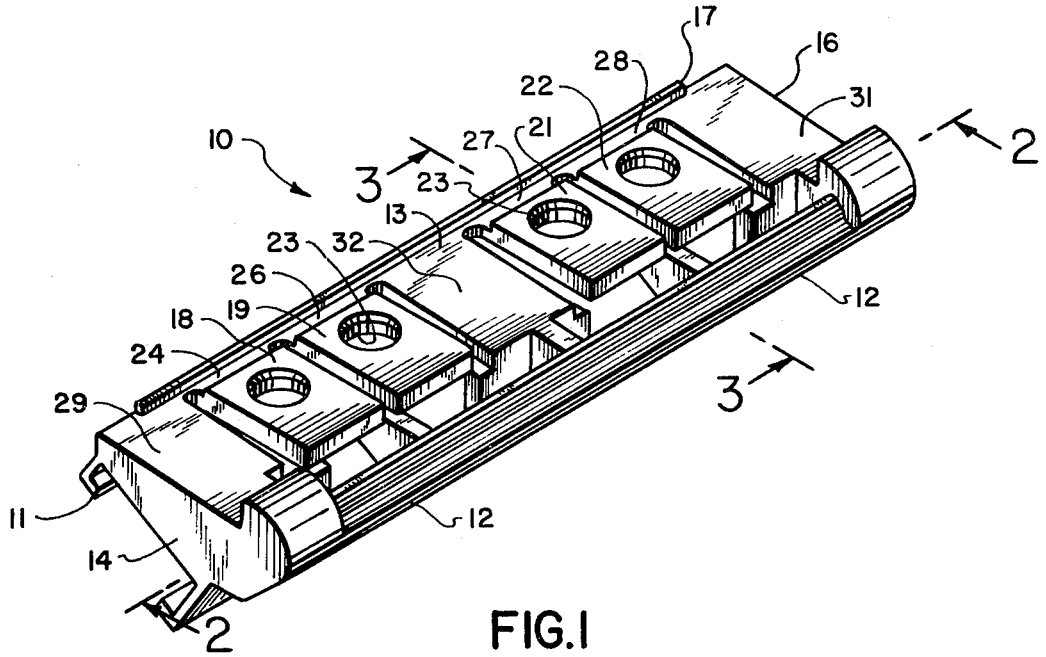
FIG.1
FIG.2
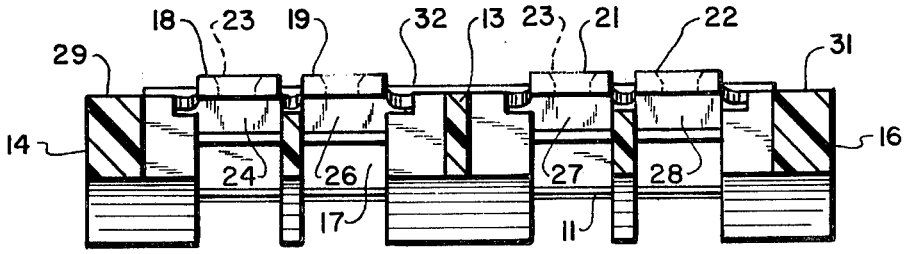

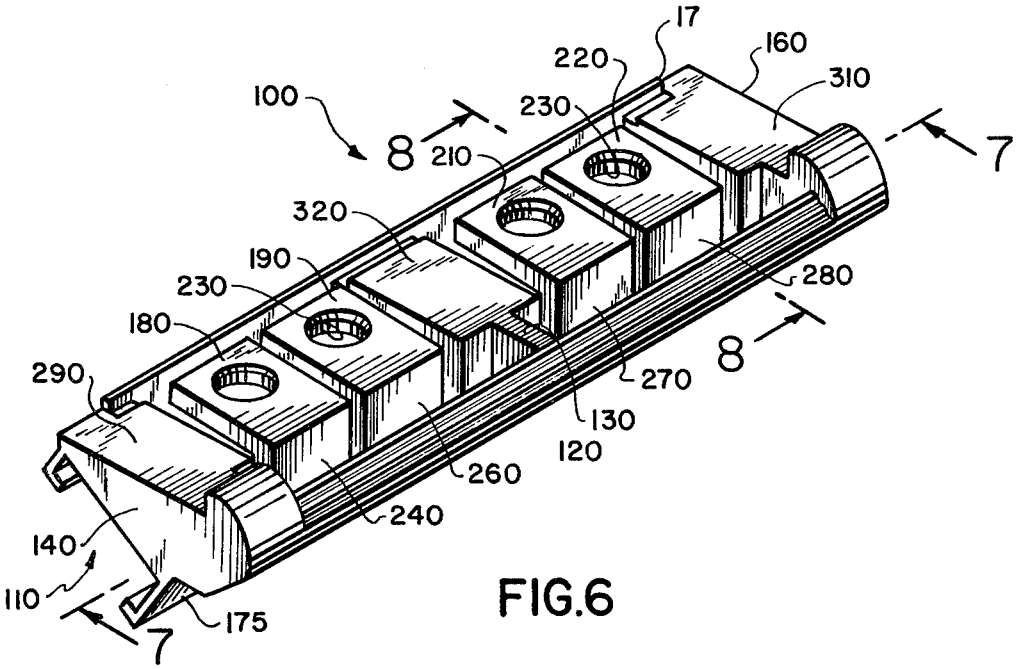
FIG.6
FIG.7
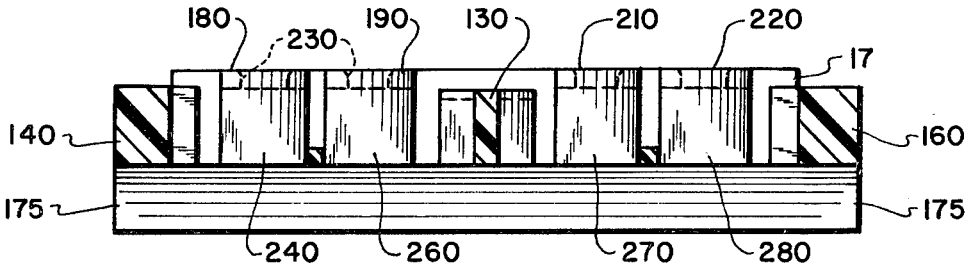

METHOD AND APPARATUS FOR CHANGING THE SHAVING ATTITUDE OF A BLADE PACKAGE

BACKGROUND OF THE INVENTION

The present invention relates to razor cartridges and relates in particular to cartridges of the so-called "bonded" type in which one or more single edge blades are secured together into a unitary package usually comprising a guard bar, a blade seat, a blade cap or blade spacer if more than one blade is involved.

The use of the language "blade", "blade pack" or "blade edge" in this specification is intended to include two or more blades with an appropriate spacer or blade separator means as necessary.

It is a particular feature of the present invention to provide a razor cartridge where the blade and blade edge bear a predetermined relationship with respect to a fixed guard bar, thereby establishing a predetermined or normal shaving characteristic. The blade pack is movably supported so that the blade edge is free to move relative to the guard bar in response to shaving forces, thereby establishing different shaving characteristics.

A further feature of the invention is the provision of a razor cartridge having a hinged blade support or blade seat so that the blade edge rotates about its hinge to establish more or less aggressive shaving action or shaving characteristics relative to normal shaving characteristic as shaving forces change.

A further feature of the invention is the provision of a blade seat hinge structure which responds to increased shaving forces to reduce blade edge exposure, i.e., bring about less aggressive shaving characteristics.

A still further feature of the invention is the provision of a blade seat hinge structure which responds to increased shaving forces to increase blade edge exposure, i.e., bring about more aggressive shaving characteristics.

DESCRIPTION OF PRIOR ART

Examples of prior art razor cartridges are disclosed in U.S. Pat. Nos. 4,094,063 and 4,288,920.

In the '063 patent, the guard 6 and the blades 8 are fixed relative to one another and the entire blade cartridge 2 pivots about yoke arms 46.

In the '920 patent, the blade cartridge body 2 includes a first body portion 22 pivotally joined to a second body portion 22 by a web 18. The cartridge body portion 22 is hinged to the handle by connecting means 26 while the body portion 24 is fixed to the handle by connecting means 34.

SUMMARY OF THE INVENTION

A representative embodiment of the present invention may comprise a cartridge body, a guard bar fixed to the body, a blade seat supporting a blade pack having a cutting edge, and hinge means connecting the blade seat to the cartridge body so that the blades are free to move or pivot relative to the body and the guard bar in response to shaving forces.

Other features and advantages of the present invention will become more apparent from an examination of the succeeding specification when read in conjunction with the appended drawings, in which;

BRIEF DESCRIPTION OF DRAWINGS

FIG. 1 shows a blade cartridge in perspective with the blade and blade cap removed and the blade seat hinged at the rear end;

FIG. 2 is a vertical section of FIG. 1 in the plane of line 2—2 as viewed in the direction of the arrows;

FIG. 6 is similar to FIG. 1 and shows the blade seat hinged at the front end, i.e., adjacent guard bar;

FIG. 7 is a vertical section of FIG. 6 as viewed in the plane of line 7—7 and in the direction of the arrows;

DESCRIPTION OF PREFERRED EMBODIMENTS

Figure 3:
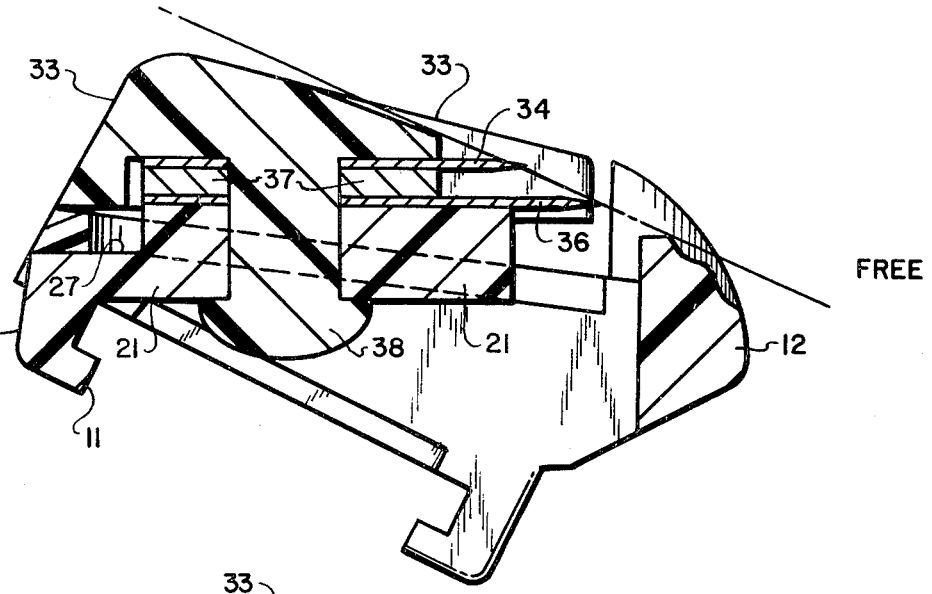
FIG. 3 is a sectional view of the illustration of FIG. 1 as viewed in the plane of the line 3—3 and in the direction of the arrows with the cap and blades in place depicting a predetermined geometry free of shaving force influences.

FIGS. 1 through 5 show an embodiment of the invention in which shaving forces operate to pivot the blade and blade seat relative to the guard bar from a free position defining a normal or predetermined shaving geometry to an operated position in which the shaving geometry (edge exposure) is less aggressive.

A cartridge body 10 formed with a conventional track 11 includes a guard bar 12 defining a leading skin-engaging surface fixed to the body, and joining a medial support member 13, end walls 14 and 16 and a rear beam 17 spanning the cartridge and connecting the end walls and the rear end of the medial support.

A plurality of generally flat and coplanar segments 18, 19, 21 and 22, each having a bore 23, are hinged to rear beam 17 by mating webs 24, 26, 27 and 28.

Collectively the segments 18, 19, 21 and 22 define a blade seat which is operable to pivot about beam 17 and thus change the attitude of blade edge relative to guard bar 12 in a manner and for a purpose which will be more apparent as this specification continues.

Obviously, the number of segments can be varied as desired, and the invention also contemplates a single (one piece) hinged blade seat extending over the medial support member 13 with member 13 suitably undercut for clearance.

As is most apparent in FIGS. 1 and 2, top surfaces 29 and 31 of the end walls 14 and 16 and top surface 32 of support member 13 all lie in a plane which is displaced or offset downwardly relative to the plane of the blade seat in order to provide clearance for the seat to pivot downwardly relative to the guard bar.

Figure 4:
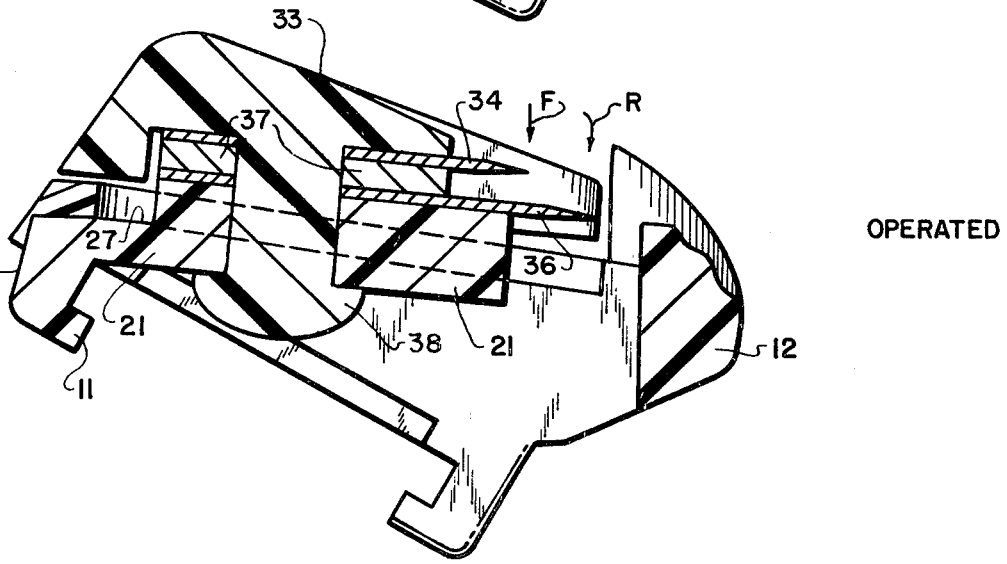
FIG. 4 is similar to FIG. 3 showing the blade seat pivoted about its hinge in response to shaving force F in an operated position and creating a less "aggressive " shaving geometry.

FIGS. 3 and 4 are similar in that a vertical section through an assembled blade cartridge, in the plane of and at the locations indicated in FIG. 1, shows a cap 33, defining a trailing skin-engaging surface blades 34 and 36 straddling spacer 37 secured to one segment 21 of blade support or blade seat by means of a conventional rivet 38 to form a rigid unit. Hinge 27 connects segment 21 to rear beam 17.

This sectional view is illustrative of how one piece or multisegmental blade seat is hinged. Obviously, if several blade seat segments are used, it may be necessary to use a rivet in each segment.

FIGS. 3 and 4 differ in that FIG. 3 shows the disposition of the blade edges relative to the guard bar at the normal or free position set in accordance with predetermined blade geometry.

FIG. shows a change in blade geometry which occurs during the course of wet shaving when a shaving force F causes the blade package to rotate or pivot about rear beam 17 in the direction of the arrow R to reduce the blade edge exposure or to render the cartridge unit less "aggressive".

Upon relaxation of shaving forces, the elastic memory of hinges 24, 26, 27 and 28 urges the blade seat and thus the blade edges to return to the normal position.

In the interest of economic high-speed mass production techniques, it is preferable that the cartridge body and associated hinges and blade seat segments be fabricated of a suitable moldable plastic material.

Figure 5:
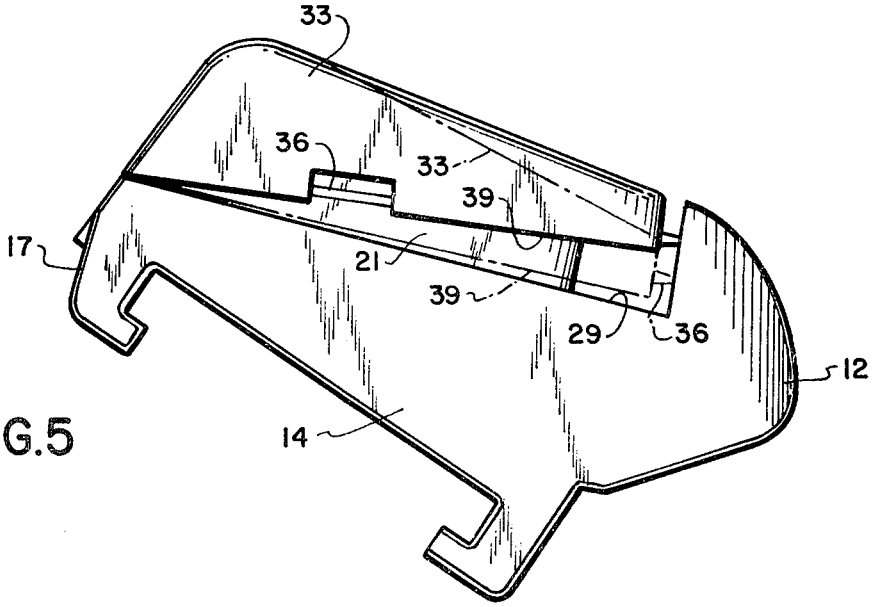
FIG. 5 is an end view of an assembled cartridge showing the normal or "free" position of the blade edge in solid lines and the operated position in dotted lines.

FIG. 5 shows the free position of the cartridge in solid lines and the operated or less aggressive position in dotted lines.

Note that the spacing of the underside 39 of cap 33 and the top surface 29 of end wall 14 controls the amount of rotation or displacement of the blade edges relative to the guard bar 12 in that these surfaces act as stop elements to limit clockwise rotation of blade edges.

FIGS. 6 and 7 show a cartridge body 100 with a track 110, a guard bar 120 fixed to the body by end walls 140 and 160 and medial support member 130. Rear beam 170 joins the end walls and the medial support member to complete the body structure. The lower skirt of the guard bar 120 defines a front beam 175.

Figure 8:
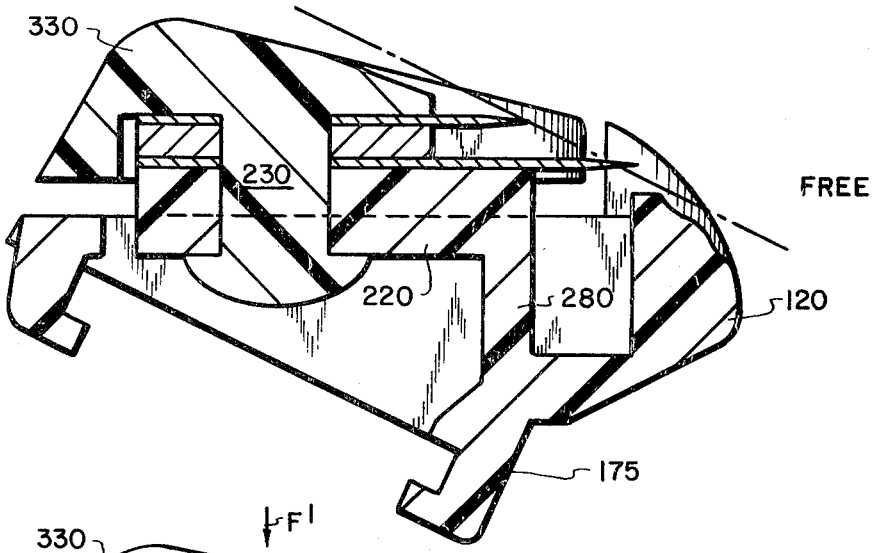
FIG. 8 is a vertical section of FIG. 6 in the plane of line 8—8 and in the direction of the arrows with the blade and blade cap in place depicting typical shaving geometry when the blade seat is hinged adjacent the guard bar and free of influence of shaving forces.
Figure 9:
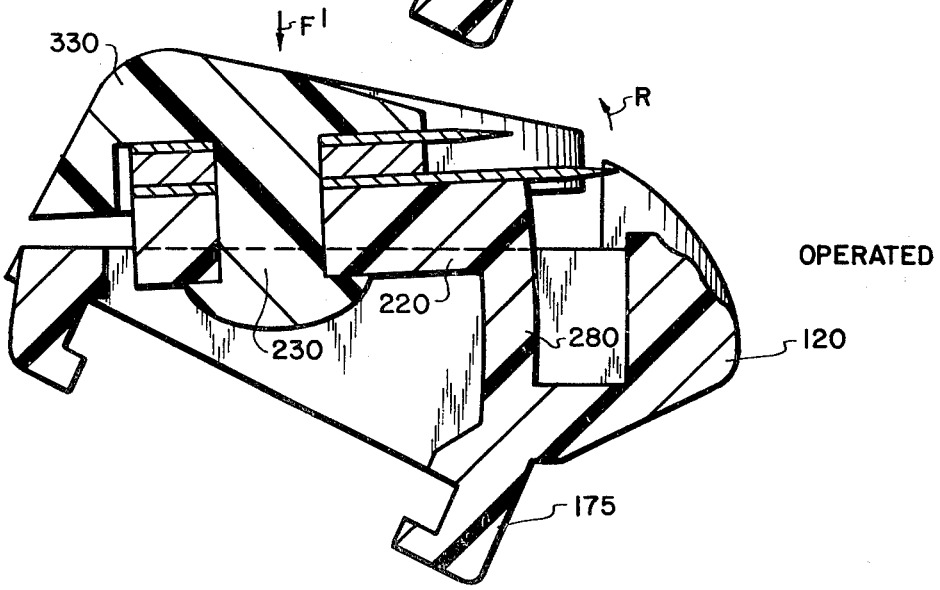
FIG. 9 is similar to FIG. 8 and shows the blade package pivoted about its hinge into an operated or more "aggressive" blade edge position.

Coplanar segments 180, 190, 210, and 220, each having a bore 230, are hinged to the front beam 175 by webs 240, 260, 270 and 280 (see FIGS. 8 and 9).

Collectively the segments 180, 190, 210 and 220 define a blade seat which is operable to pivot counterclockwise about body 100 to change the attitude of the blade relative to the guard bar 120 in response to shaving force F'.

In this embodiment of the invention, the blade package responds to shaving forces F' to change the disposition of the blade edges relative to the guard bar from the predetermined or free setting of FIG. 8 to the operated and more aggressive edge exposure of FIG. 9.

Figure 10:
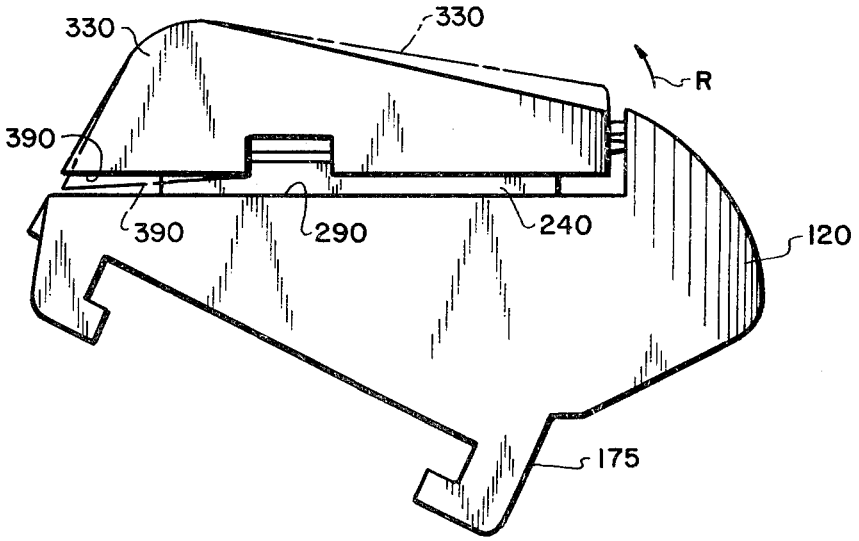
FIG. 10 is an end view of the cartridge of FIGS. 8 and 9 showing the "free" position in solid lines and the operated position in dotted lines.

FIG. 10 shows the end view of this embodiment of the razor cartridge, the solid line position representing the normal or free position while the dotted lines show a more aggressive blade edge exposure developed by shaving forces.

Here again the elastic memory of the hinges 240, 260, 270 and 280 act to return the blade edges to the free position as shaving forces are released.

As in the embodiment of FIGS. 1 through 5, the spacing of the underside 390 of cap and top surfaces of the end walls 290 and 310 limit counterclockwise motion and the top surfaces of the end walls and the medial support lie in a plane which is offset from the plane of the blade seat to provide freedom from pivoting.

The blade seat may be segmental or a single leaf as desired.

What is claimed is:

1. In a razor head including a body portion of the type which makes a slidable and releasable connection with a handle, a guard bar fixed to a leading edge of the body portion, a cap, a plurality of blade seats, a blade spacer and a pair of single edge blades straddling the spacer, the improvement comprising:

each of said plurality of blade seats being provided with at least one aperture, each of said blades and said spacer being provided with apertures aligned with said apertures in said plurality of seats, fastening means connected to said cap and extending through said aligned apertures in said blades, spacer, and blade seats for connecting the cap, blade seat, blade spacer and blades together permanently into a relatively rigid unit, and hinge means connecting the blade seats to the body portion so that shaving forces acting on the cap cause the unit to pivot relative to the body portion without disturbing the relative position of the blades with respect to one another.

2. The razor head of claim 1 in which the body portion is formed with a rear beam opposite the guard bar and said hinge means connects the blade seats to said rear beam whereby shaving forces tend to render the blade edges less aggressive.

3. The razor head of claim 1 in which the body portion is formed with a front beam below the guard bar and said hinge means connects the blade seats to said front beam whereby shaving forces tend to render the blade edges more aggressive.

* * * * *